US006220974B1

(12) United States Patent
Moore

(10) Patent No.: US 6,220,974 B1
(45) Date of Patent: Apr. 24, 2001

(54) TRAINING DEVICE FOR KICKING SOCCER BALLS

(76) Inventor: Richard S. Moore, 124 Monaco Rd., West Melbourne, FL (US) 32904

( * ) Notice: Subject to any disclaimer, the term of this patent is extended or adjusted under 35 U.S.C. 154(b) by 0 days.

(21) Appl. No.: 09/281,191

(22) Filed: Mar. 30, 1999

(51) Int. Cl.[7] ..... A63B 69/00
(52) U.S. Cl. ..... 473/430; 473/422; 473/416
(58) Field of Search ..... 473/422–426, 473/429, 430, 478, 575

(56) References Cited

U.S. PATENT DOCUMENTS 1,655,599 * 1/1928 Dolan, Jr. ..... 473/423
4,322,075 * 3/1982 Hynes ..... 473/430
5,280,922 * 1/1994 Jones ..... 473/428
5,611,539 * 3/1997 Watterson et al. ..... 473/429
5,688,195 * 11/1997 Caso ..... 473/429
5,823,895 * 10/1998 Rasic ..... 473/430
6,000,944 * 10/1998 Schiefer ..... 473/430

* cited by examiner

*Primary Examiner*—Stephen F. Gerrity
*Assistant Examiner*—Mitra Aryanpour
(74) *Attorney, Agent, or Firm*—Jack N. McCarthy

(57) ABSTRACT

A ball kicking apparatus for (1) practicing kicking a soccer-type ball; (2) training to be a goal keeper to receive a ball; and (3) obtaining aerobic exercise, where a frame has two upstanding members for supporting a soccer-type ball by a first cord to be kicked and a second cord for controlling the path of the kicked ball. A netted bag for holding the soccer-type ball can be used and arms can connect the frame to a wall for positioning and storing on the wall.

14 Claims, 6 Drawing Sheets

TRAINING DEVICE FOR KICKING SOCCER BALLS

TECHNICAL FIELD

This invention relates to a ball kicking device which will automatically return the ball to a kicking position. This device can also be used for aerobic exercise.

BACKGROUND ART

Patents setting forth a background for this invention are: U.S. Pat. Nos. 4,050,694; 4,158,458; 4,322,075; 4,477,083; 4,576,379; 4,720,095; 4,836,542; 5,037,113; 5,280,922; 5,398,940; and 5,692,975.

DISCLOSURE OF INVENTION

It is an object of this invention to allow an individual to practice kicking a soccer-sized ball repeatedly, getting continuous repetitions, or kicks, at the ball in a stationary position while using only a few feet of space.

Another object of the invention is to allow a person to get an aerobic workout while repeatedly and continuously kicking a ball.

A further object of the invention is to improve or exercise a person's legs or feet and coordination motor skills by repeatedly kicking a moving ball while standing in a stationary position, needing only a few feet of room to accomplish this.

Another object of this invention is to practice kicking a soccer-like ball in the confines of one's house, or other contained area, without holding a soccer-like ball attached to a cord in one's hand. This invention allows one to practice kicking the ball with power having one's hands free in the confines of one's home, needing no more than a minimum amount of space.

A further object of this invention is to have a training device for kicking a soccer-type ball having a frame with two upstanding members with a crossbar between them; the soccer-type ball hangs by a first cord from the crossbar to be placed at a kicking height, a second cord is attached between the soccer-type ball and an upstanding member to control the path of the soccer-type ball about the upstanding member after it has been kicked. To change the length of the second cord to place the soccer-type ball closer to the upstanding member will change the speed at which the soccer-type ball returns to the kicker.

Another object of the invention is to have a training device with two upstanding members with a crossbar at the top thereof (a) wherein a bottom section of each upstanding member can be placed in holes in the ground or concrete flooring; (b) wherein the bottom of each upstanding member can be held in a movable frame base (including weighted members); and (c) wherein the upstanding members are connected to a wall by supporting members.

A further object of this invention is to have a movable base formed with a plywood platform having supporting members fixed therewith for holding the bottom of spaced ends of upstanding members of a vertical frame for a training device.

Another object of this invention is to have a movable base formed by spaced weighted members, one weighted member for holding the bottom of each leg of a downwardly projecting member of a training device. An interconnecting member could connect the two spaced weighted members together for spacing and stability.

A further object of the invention is to provide a training device for kicking a soccer-type ball wherein the distance a soccer-type ball hangs down below a horizontal crossbar by a first cord relative to a kicking surface can be changed, and the distance a soccer-type ball can be spaced from a vertical upstanding member can be changed by a second cord.

Another object of the invention is to provide a training device for goal keepers to catch a soccer-type ball where the hands can be used to contact the soccer-type ball in play. The training device is used with only one cord hanging a soccer-type ball from a horizontal crossbar. The goal keeper kicks the soccer-type ball which starts to wrap around the crossbar and as the soccer-type ball comes around the crossbar, the goal keeper can catch the soccer-type ball.

A further object of this invention is to provide a flat movable base with two vertical holding tubes spaced to receive each vertical upstanding member of the device. Each holding tube would be sufficiently high enough to give adequate support to the upstanding members and training device and could be of a type which could be fixed to the ground by placing metal rods through holes in the flat base into the ground. The base could take different shapes on the ground so that the metal rods would give maximum support.

Another object of the invention is to have a modified training device with a "bounce" board rotatively mounted on one upstanding member so that the board can be fixed at different angular positions, the positioning of the board controls the speed of the soccer-type ball back to the kicker's foot.

BEST MODE FOR CARRYING OUT THE INVENTION

Figure 1:
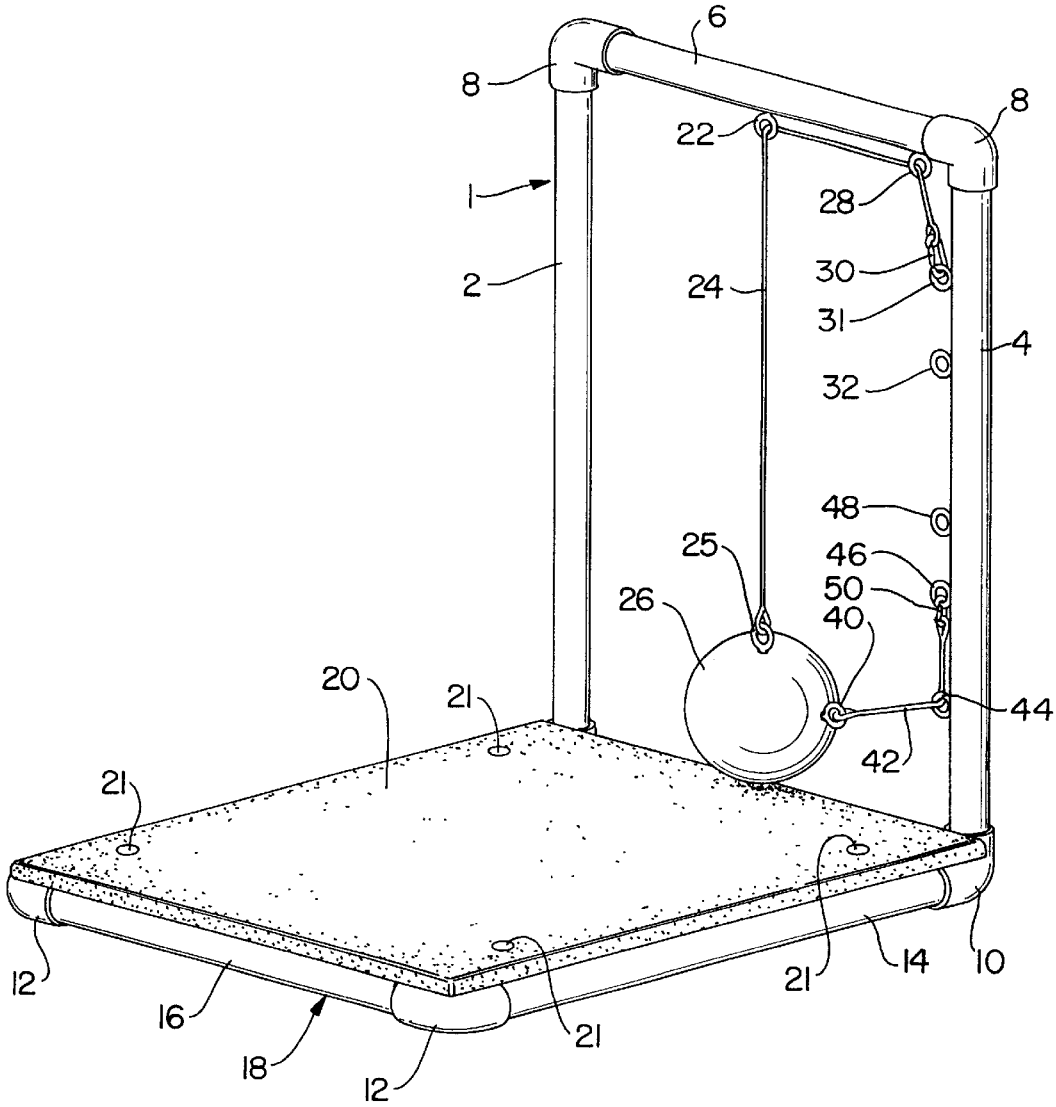
FIG. 1 is a perspective view of the training device showing a soccer-type ball connected to a frame placing the ball at ground level for kicking.
Figure 2:
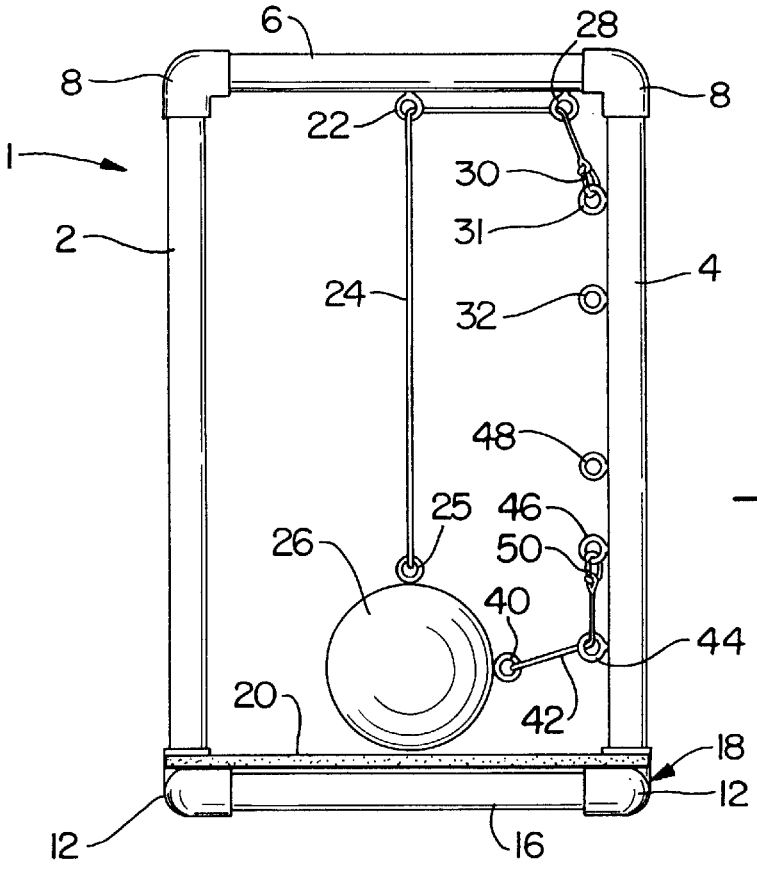
FIG. 2 is a rear view of the training device showing the positioning of a platform, representing ground level, on which the user would stand.
Figure 3:
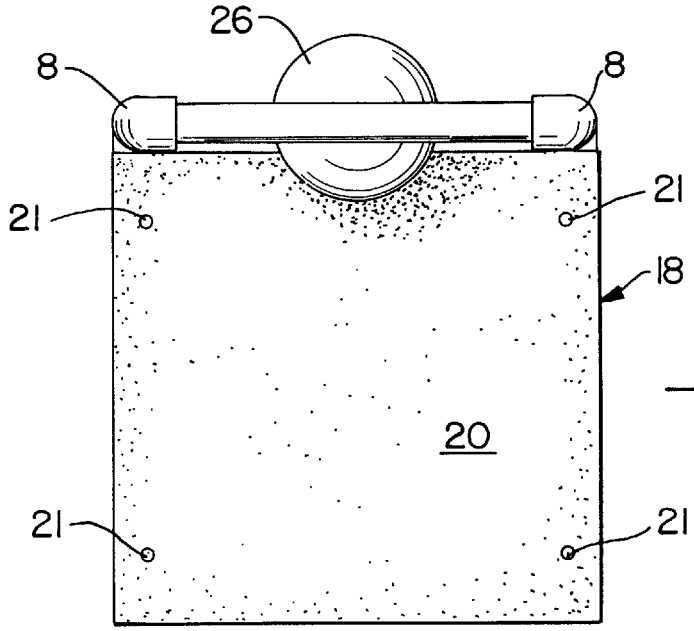
FIG. 3 is a top view of the training device.

Referring to FIGS. 1, 2 and 3, this training device 1 includes two upstanding members 2 and 4, and a top crossbar 6. The top of each upstanding member 2 and 4 is connected to one of the ends of the crossbar 6. In a construction made of PVC pipe, a 90° joint 8 was used to make this connection.

The bottom of each upstanding member 2 and 4 has a horizontal floor member 14 extending rearwardly therefrom by the use of a 90° joint 10, which permits a plywood platform 20 to be placed on top of the rearwardly extending floor members 14 forming a platform device 18. A rear cross member 16 is fixed between the horizontal floor members 14 at their rear ends by 90° joints 12 to form a support frame. Other cross members between the floor members 14 can be used if necessary. Other support devices can be used under the plywood platform 20, such as spaced blocks or legs. The plywood platform 20 is fixed to the horizontal floor members 14 by screws 21. However, if desired, a platform device 18 can be made without floor members 14, cross member 16, and 90° joints 10 and 12 to be placed on a flat surface with upstanding supports at each forward end thereof to receive the lower ends of the upstanding members 2 and 4, such as the upwardly facing legs of 90° joint 10. Other sheet material can be used as a platform 20 to support the upstanding members 2 and 4 and the crossbar 6.

Soccer-type ball 26 has a first eye member, or loop, 25 fixed thereon on one side and a second eye member, or loop, 40 fixed thereon at 90° to the first eye member, or loop, 25. The crossbar 6 has an eye member 22 fixed thereto below the crossbar 6. A cord 24 is fixed to the eye member, or loop, 25 of the soccer-type ball 26 and passed through the eye member 22 of the crossbar 6 and through a second eye member 28 adjacent one end of the crossbar 6. The cord 24 has a hook device 30 at its free end thereof for positioning the ball 26 at a specific position for kicking. A couple of eye members, 31 and 32, are fixed to the inside of the upper part of upstanding member 4 to receive the hook device 30. The eye member 31 is positioned so that when the hook device 30 is hooked into it, the cord 24 will be fixedly positioned with respect to the crossbar 6, as if it were tied thereon, so that the ball 26 will be next to the platform 20, representing a ground level position for kicking. The eye member 32 is positioned so that when the hook device 30 is hooked into it, the ball 26 will be a distance above the platform 20. The placement of the eye member 32 sets this desired distance. Eye members 31 and 32 can be placed on crossbar 6, if desired, correcting the length of cord 24 to obtain the proper ball positions.

With the ball 26 hanging straight downwardly, a cord 42 is connected to the eye member, or loop, 40 of the soccer-type ball 26 and passes through an eye 44 on upstanding member 4. The cord 42 has a hook device 50 at its free end thereof for moving the ball 26 horizontally. A couple of eye members, 46 and 48, are fixed to the inside of the lower part of upstanding member 4 to receive the hook device 50. The eye member 46 is positioned so that when the hook device 50 is hooked into it, the ball 26 will be in the center between the upstanding members 2 and 4 when the hook device 30 is in eye member 31. The eye member 48 is positioned so that when the hook device 50 is hooked into it, the ball 26 is drawn close to the upstanding member 4.

The eye members 22 and 28 can have a small opening in their circumference adjacent the crossbar 6 to remove the cord 24 and ball 26 from the training device 1 if desired. This will permit the ball 26 and cord 24 to be used for hand-held practice.

A hook device can be used in the connection of cord 42 to the eye member,or loop, 40, of ball 26 for easy removal of the ball 26. To remove the cord 42, the eye member 44 can have its eye large enough to pass the hook device 50 therethrough.

In a modified form, the training device 1 can have the cord 42 extend from the ball 26 and pass through a hole extending through the upstanding member 4 to the outside of the upstanding member 4, and the eye members 46 and 48 can be located on another side of the upstanding member 4, such as the outside.

A player stands on the platform 20 facing the frame members 2 and 4 and crossbar 6 with the soccer-type ball 26 hanging down a fixed distance from said crossbar 6 in front of the player. The player can kick the ball 26 and the cords 24 and 42 will start to wrap around the upstanding member 4 until the ball 26 stops; the ball 26 will then return to its starting position where the player will then kick it again to obtain accuracy and repetition in movement. The device shown stands around three feet high with approximately two feet between the members 2 and 4. The construction of the device can change with the size of the player being coached, for example. As explained above, the distance the soccer-type ball hangs down from crossbar 6 can be made to be adjustable for kicking. This device could also be used for aerobic training and increasing movement of the legs and strengthening thereof.

Figure 4:
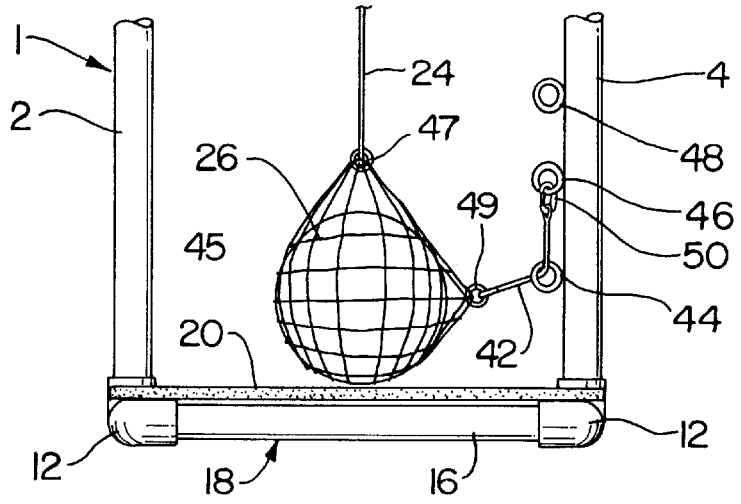
FIG. 4 is a partial rear view of FIG. 2 where the soccer-type ball is connected to the frame by the use of a netted bag.

FIG. 4 shows the lower part of a training device 1 where the ball 26 being used is held in a netted bag 45. The top of the netted bag 45 is fixed to the cord 24 by the use of a ring 47. The side of the netted bag 45 is fixed to the cord 42 by the use of a ring 49. Other connecting means can be used between the cords 24 and 42, and the netted bag 45 such as clips, knots, or similar devices. The structure of the training device 1 is the same as that shown in FIG. 2. A real soccer ball can be used by placing it in the netted bag 45 to derive the exact feel of the surface of a real soccer ball against one's feet.

Figure 5:
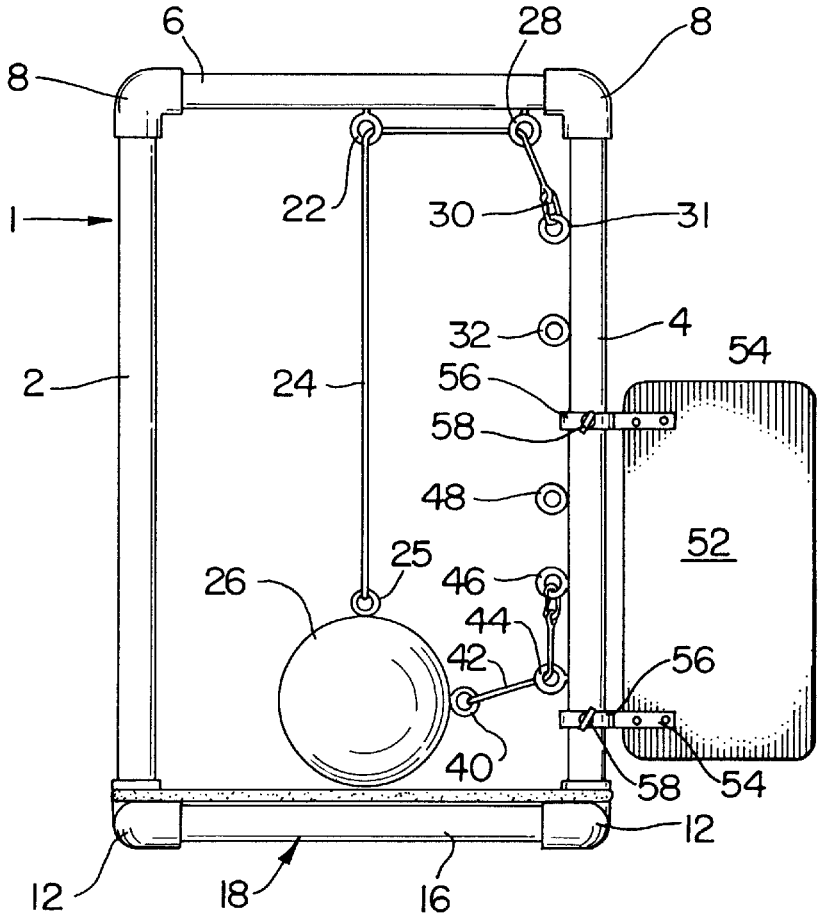
FIG. 5 is a rear view of a modification of the training device showing a side "bounce" board to control the return time of the soccer-type ball to the foot of the kicker.

FIG. 5 shows the training device 1 of FIG. 2 with a modification thereon for controlling the speed of the return of the ball 26. This modification consists of a "bounce" board 52 for positioning in an angular position around the upstanding member 4 to vary the distance the kicked ball 26 must travel to change direction and return to the kicker. The "bounce" board 52 has two brackets 54 fixedly attached to the top and bottom of the "bounce" board. These brackets 54 each have a circular portion 56 for rotatively moving about the upstanding member 4. Each circular portion 56 has a turn screw 58 thereon to fix the angular position of the "bounce" board 52 on the upstanding member 4. The "bounce" board 52 can use other arrangements connecting it to the frame to fix it at a specific angular position, and can be made of many materials such as wood, plastic, composition material, etc.

Figure 6:
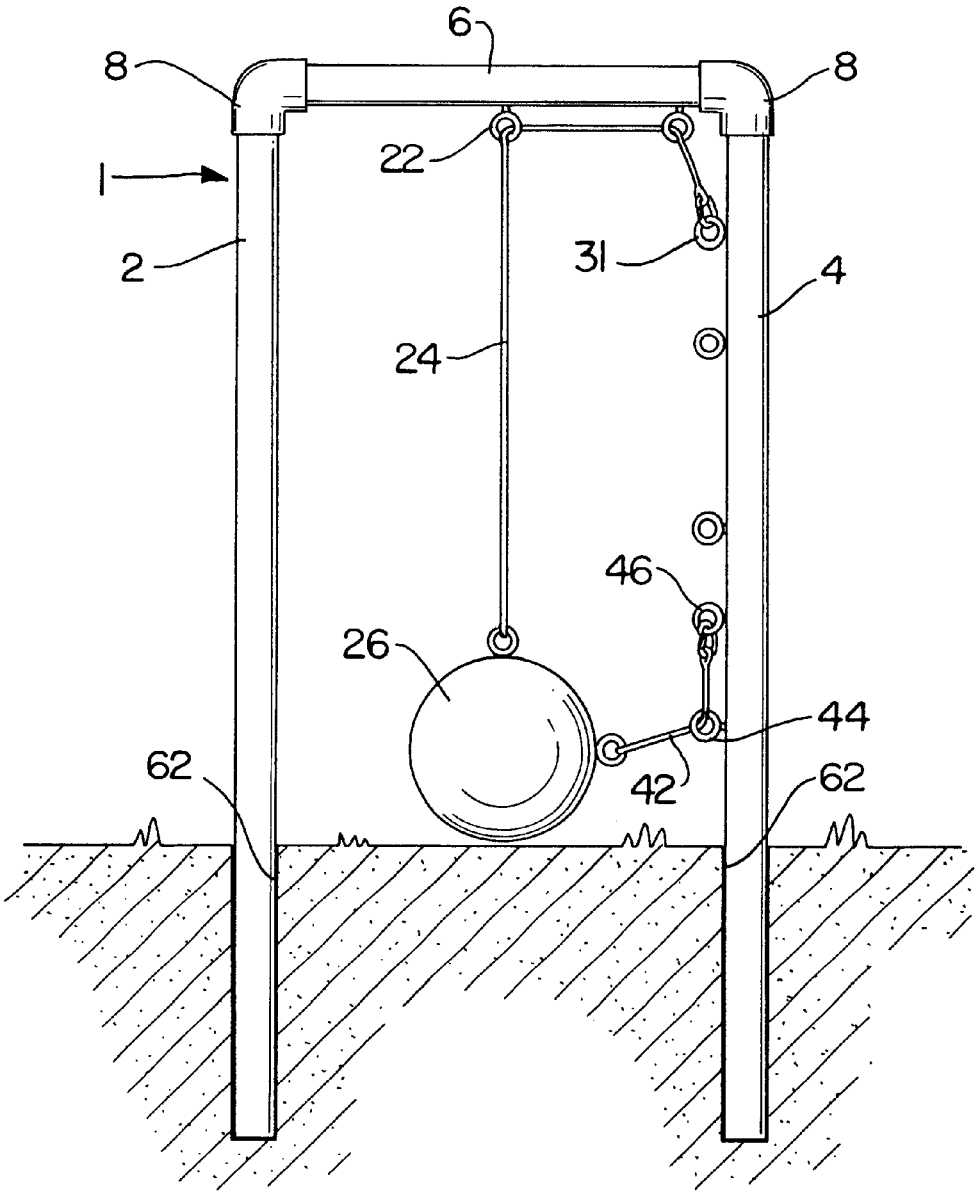
FIG. 6 is a rear view of the training device wherein the two upstanding members of the frame are extended to be positioned in pre-formed receiving holes in the ground or concrete flooring.

FIG. 6 is a modification of the training device 1 where the upstanding members 2 and 4 are elongated to extend into openings 62 in the ground or in a floor, such as concrete. This eliminates the use of a separate platform device 18. In a construction where concrete is being poured to form a base for a training device, tubular members can be properly placed in position to receive the upstanding members 2 and 4, and the concrete poured around them; the tubular members can be made of varied materials such as metal or plastic. An existing concrete floor could have openings 62 drilled therein to receive the upstanding members 2 and 4 so that the training device could be put in place to practice when desired. The floor openings 62 could have caps (not shown) to be placed over the openings 62 when the training device 1 is stored away.

Figure 7:
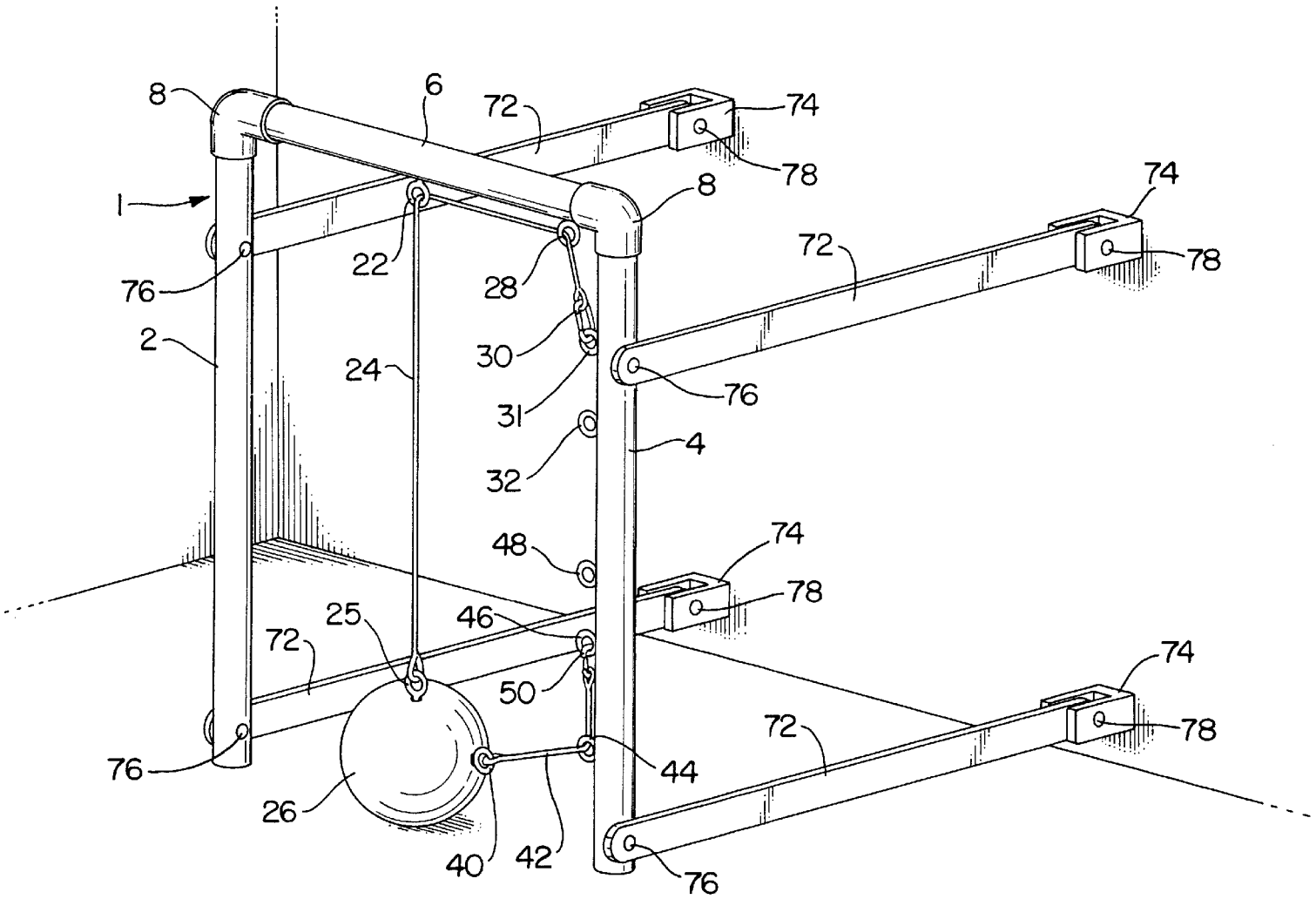
FIG. 7 is a perspective view of the training device wherein the two upstanding members are connected to a wall for supporting the training device with the bottom of the two supporting members positioned on a floor.

FIG. 7 shows a training device 1 attached to a wall, for example as in a garage, where openings 62 for the upstanding members 2 and 4 are not needed. The arms 72 extending from each upstanding member 2 and 4 are shown pivoted at one end by pivot members 76 to the upstanding member 2 and 4 and pivoted at the other end by pivot members 78 to a bracket 74 on the wall. This permits the training device 1 to be lifted upwardly and placed substantially against the wall, making room for other activity. A hook (not shown) or other holding device on the wall can maintain the training device 1 in an upright position. Other devices can be used to maintain the training device 1 in its upright position. The arms 72 can be fixed in position, if desired.

Figure 8:
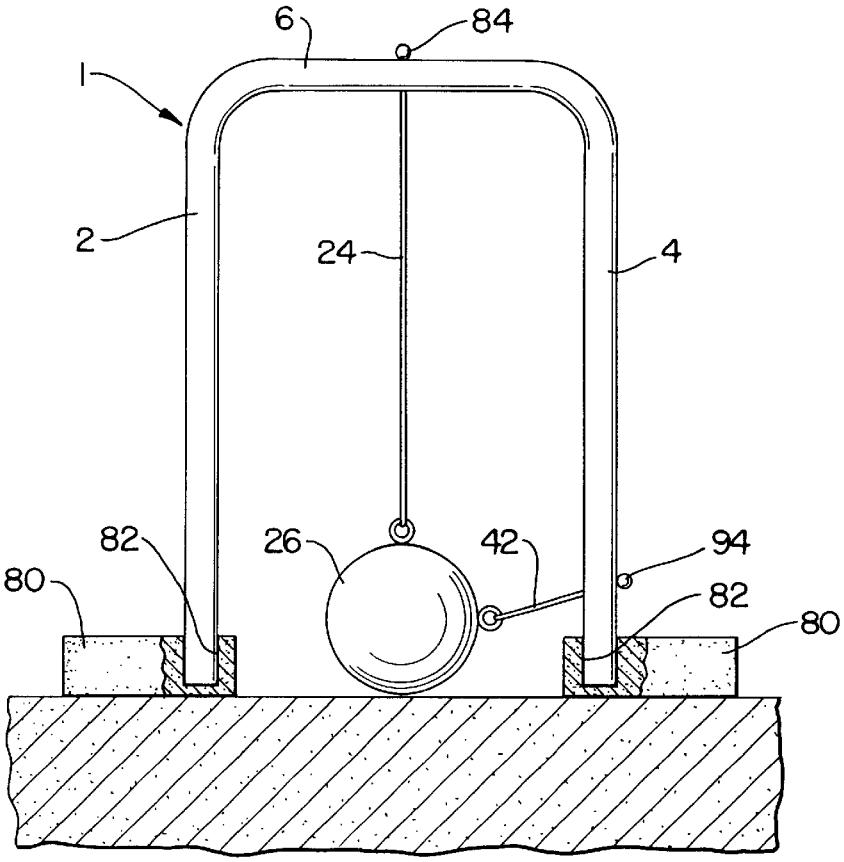
FIG. 8 is a rear view of a modification of the training device wherein the two upstanding members and horizontal member are integrally connected at the top with a curved connection, each upstanding member has its own weighted member at its bottom, and a different cord attachment is used.

FIG. 8 is a modification of the training device 1 using a PVC pipe where the upstanding members 2 and 4 are made integral with the crossbar 6 at the top. Two spaced weighted members 80 are positioned on a kicking surface so that an opening 82 in each weighted member 80 receives the lower end of one of the cooperating upstanding members 2 and 4. The opening 82 in each weighted member 80 is placed adjacent one side of the weighted member 80 so that when the weighted members are placed to receive the upstanding members 2 and 4, the openings 82 are positioned opposite each other to allow adequate kicking space between the weighted members 80. A member could connect the two weighted members 80 to properly space them for use. This would provide some stability in the base.

The weighted members 80 can be made in a number of ways and of different sizes. For example, the weighted member 80 can be formed of heavy material or made hollow and filled with water or sand. In a training device 1, the weighted members 80 were formed by pouring concrete in a rectangular box where a cylindrical member was positioned in the box to form an opening 82 in the formed weighted member 80 to receive an upstanding member.

This FIG. 8 also shows a different method for connecting the first cord 24 to the crossbar 6. The upper part of this cord 24 extends through an opening in the crossbar 6 to the top thereof, with the cord 24 having a small ball member 84 connected to the end of the cord 24 above the crossbar 6 to permit the soccer-type ball 26 to hang down and be positioned at a kicking surface, as shown in FIG. 8.

Figure 9:
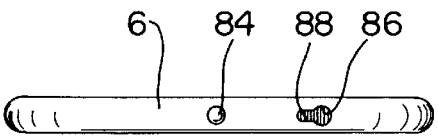
FIG. 9 is a view of the top of the horizontal member and two curved connections of FIG. 8 showing the top cord connection.
Figure 10:
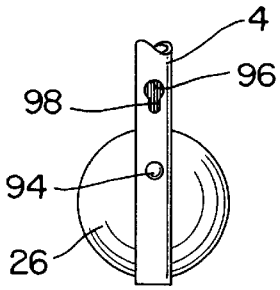
FIG. 10 is a side view of the bottom of the right side of the training device of FIG. 8 with the weighted member removed showing the side cord connection.

To position the soccer-type ball 26 above the kicking surface, the small ball member 84 is raised, lifting the soccer-type ball 26 by the cord 24. The small ball member 84 is placed in a hole 86 (see FIG. 9) in the top of the crossbar 6; this hole 86 has a short narrow channel section 88 extending toward the center of the crossbar 6 which receives the cord 24 while the small ball member 84 fits into crossbar 6 under the narrow channel section 88.

This FIG. 8 also shows a different method for connecting the second cord 42 between the side of the soccer-type ball 26 and the upstanding member 4. The connection is made in a manner similar to the connection of the first cord 24 to the crossbar 6. The free end of the cord 42 extends through an opening in the upstanding member 4 with the cord 42 having a small ball stop member 94 connected to the end of the cord 42 on the outside of the upstanding member 4 to fixedly position the distance that the soccer-type ball 26 can move away from the upstanding member 4 when the soccer-type ball 26 is kicked.

The upstanding member 4 has a hole 96 spaced a short distance upwardly from the opening through the upstanding member 4 holding the second cord 42. To move the soccer-type ball 26 toward the upstanding member 4, the small ball stop member 94 is placed in the opening 96; this hole 96 has a short narrow channel section 98 extending toward the bottom of the upstanding member 4 which receives the cord 42 while the small stop member 94 fits into the upstanding member 4 under the narrow channel section 98.

It is noted that if one wants to practice kicking to the left, the upstanding members 2 and 4 can be lifted out of their supporting openings and reversed in position. For example, this can be done easily in FIG. 6. It can also be done in FIGS. 1, 4, and 5 if the upstanding members 2 and 4 are not fixed in their respective 90° joints 10 of platform device 18, and in FIG. 8 if the upstanding members 2 and 4 are not fixed in openings 82. In FIG. 7 it will be necessary to have the pivot members 76 removed, the upstanding members 2 and 4 reversed, and the pivot members 76 replaced. A duplicate set of eye members 28, 31, 32, 44, 46 and 48 could be placed on the other side of the training device 1 where the training device 1 is fixed in position as FIG. 7 would be with fixed arms 72.

This training device 1 can be used to also help train goal keepers by disconnecting the second cord 42 from the soccer-type ball. This permits the ball when it is kicked by the trainee to go directly around the horizontal crossbar 6 and back to the trainee to catch the soccer-type ball 26. The soccer-type ball 26 can be repetitively kicked with varying forces to give the trainee practice with handling catching a soccer-type ball 26 at different incoming speeds.

The hook devices 30 and 50 used in FIGS. 1–7 had a side with a spring action to hold the hook devices 30 and 50 in place once hooked on an eye member. The spring action permits the hook device 30 or 50 to be released from one eye member and hooked on another. In a training device 1, with the soccer-type ball hanging straight down, the soccer-type ball was spaced a distance from the upstanding member to which it was connected by less than the diameter of the soccer-type ball.

While the principles of the invention have now been made clear in illustrative embodiments, it will become obvious to those skilled in the art that many modifications and arrangements are possible without departing from those principles. The appended claims are, therefore, intended to cover and embrace any such modifications, within the limits of the true spirit and scope of the invention.

I claim:

1. An apparatus for training someone to play soccer comprising, a frame having two vertical upstanding spaced members for extending above a kicking surface, said upstanding members having a horizontal member between them, a ball, said ball being connected to said horizontal member by a first non-elastic cord for kicking, said ball being connected to one of said upstanding members by a second non-elastic cord to control the path of the ball around said upstanding member after it has been kicked, wherein said upstanding members have arms for pivotally connecting them to a wall.

2. An apparatus as set forth in claim 1 wherein the distance between the surface of the ball when it hangs straight down from said horizontal member and the upstanding member connected to the second non-elastic cord is less than the diameter of the ball.

3. An apparatus for training someone to play soccer comprising, a frame having two vertical upstanding spaced members for extending above a kicking surface, said upstanding members having a horizontal member between them, a ball, said ball being connected to said horizontal member by a first non-elastic cord for kicking, said ball being connected to one of said upstanding members by a second non-elastic cord to control the path of the ball around said upstanding member after it has been kicked, wherein a "bounce" board is mounted on the upstanding member connected to the second non-elastic cord to intercept the path of the kicked ball to return the ball to the kicker.

4. An apparatus as set forth in claim 3 wherein said "bounce" board can be fixed at different angular positions.

5. An apparatus as set forth in claim 3 including a platform device, said platform device having members for supporting said upstanding members.

6. An apparatus for training someone to play soccer comprising, a frame having two vertical upstanding spaced members for extending above a kicking surface, said upstanding members having a horizontal member between them, a ball, said ball being connected to said horizontal member by a first non-elastic cord for kicking, said ball being connected to one of said upstanding members by a second non-elastic cord to control the path of the ball around said upstanding member after it has been kicked, including a platform device, said platform device having members for supporting said upstanding members, wherein said members for supporting said upstanding members have openings therein to receive the lower end of the upstanding members.

7. An apparatus for training someone to play soccer comprising a frame having two vertical upstanding spaced members for extending above a kicking surface with a horizontal member between them, a ball, said ball having a first non-elastic cord attached thereto, means connecting said first non-elastic cord to said frame so that said ball hangs straight down from said horizontal member between said upstanding members for placing said ball at a kicking surface, said ball having a second non-elastic cord attached thereto, said second non-elastic cord being connected to one of said upstanding members to control the path of the ball after it has been kicked, said device stands around three feet high, and the upstanding members are separated by approximately two feet wherein the distance between the surface of the ball when it hangs straight down from said horizontal member and the upstanding member connected to the second non-elastic cord is less than the diameter of the ball, wherein said upstanding member connected to the second non-elastic cord has an upstanding board mounted thereon to intercept the path of the ball being kicked to provide a quicker return of the ball to the kicker.

8. An apparatus as set forth in claim 7 wherein said board can be fixed at different angular positions to vary the return of the soccer-type ball to the kicker.

9. An apparatus for training someone to play soccer comprising, a frame having two vertical upstanding spaced members for extending above a kicking surface, said upstanding members having a horizontal member between them, a ball, said ball being connected to said horizontal member by a first non-elastic cord for kicking, said ball being connected to one of said upstanding members by a second non-elastic cord to control the path of the ball around said upstanding member after it has been kicked, including a platform device, said platform device having members for supporting said upstanding members, wherein said members for supporting said upstanding members have openings therein to receive the lower end of the upstanding members, wherein a "bounce" board is mounted on the upstanding member connected to the second non-elastic cord to intercept the path of the kicked ball to return the ball to the kicker.

10. An apparatus as set forth in claim 9 wherein said "bounce" board can be fixed at different angular positions.

11. An apparatus for training someone to play soccer comprising, a frame having two vertical upstanding spaced members for extending above a kicking surface, said upstanding members having a horizontal member between them, a ball, said ball being connected to said horizontal member by a first non-elastic cord for kicking, said ball being connected to one of said upstanding members by a second non-elastic cord to control the path of the ball around said upstanding member after it has been kicked, including a platform device, said platform device having members for supporting said upstanding members, wherein said members for supporting said upstanding members have openings therein to receive the lower end of the upstanding members, wherein said upstanding members have arms for pivotally connecting them to a wall.

12. An apparatus for teaching someone to repeatedly make kicks at a soccer-sized ball comprising, a frame having two vertical upstanding spaced members for extending above a kicking surface, said upstanding members having a horizontal member between them, a ball, said ball having two cord connecting members on its surface spaced 90° apart, a first non-elastic cord, said first non-elastic cord being connected between said horizontal member and one of said ball connecting members so that said ball hangs straight down for kicking, a second non-elastic cord, said second non-elastic cord being connected between one of said upstanding members and the other of said ball connecting members to control the path and distance the ball travels around said upstanding member each time after it has been kicked and before it returns to a position for the next kick, including a platform device, said platform device having members for supporting said upstanding members.

13. An apparatus as set forth in claim 12 wherein to obtain a desired repetition of continuous kicks the distance between the surface of the ball and the upstanding member connected to the second non-elastic cord is less than the diameter of the ball.

14. An apparatus for teaching someone to repeatedly make kicks at a soccer-sized ball comprising, a frame having two vertical upstanding spaced members for extending above a kicking surface, said upstanding members having a horizontal member between them, a ball, said ball having two cord connecting members on its surface spaced 90° apart, a first non-elastic cord, said first non-elastic cord being connected between said horizontal member and one of said ball connecting members so that said ball hangs straight down for kicking, a second non-elastic cord, said second non-elastic cord being connected between one of said upstanding members and the other of said ball connecting members to control the path and distance the ball travels around said upstanding member each time after it has been kicked and before it returns to a position for the next kick, wherein said upstanding members have arms with one end pivotally connected thereto, said other end of said arm having a pivotal connection for connection to a wall.

* * * * *